US009561645B2

(12) United States Patent
Hiramoto

(10) Patent No.: US 9,561,645 B2
(45) Date of Patent: Feb. 7, 2017

(54) IMAGE-FORMING APPARATUS

(71) Applicant: Konica Minolta, Inc., Chiyoda-ku, Tokyo (JP)

(72) Inventor: Kenichirou Hiramoto, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/108,430

(22) PCT Filed: Dec. 9, 2014

(86) PCT No.: PCT/JP2014/082522
§ 371 (c)(1),
(2) Date: Jun. 27, 2016

(87) PCT Pub. No.: WO2015/098496
PCT Pub. Date: Jul. 2, 2015

(65) Prior Publication Data

US 2016/0318300 A1 Nov. 3, 2016

(30) Foreign Application Priority Data

Dec. 27, 2013 (JP) ..... 2013-270645

(51) Int. Cl.
*B41J 2/045* (2006.01)
*B41J 2/21* (2006.01)

(52) U.S. Cl.
CPC ..... *B41J 2/0451* (2013.01); *B41J 2/04586* (2013.01); *B41J 2/2135* (2013.01)

(58) Field of Classification Search
CPC ..... B41J 2202/20; B41J 2/2132; B41J 29/393; B41J 2/2135; B41J 21/145; B41J 2202/19; B41J 2/04505; B41J 2/04541; B41J 2/04586; B41J 2/04508; B41J 2/0451;B41J 3/543; B41J 2/2139; H01Q 21/0025; G06K 2215/111
See application file for complete search history.

(56) References Cited

U.S. PATENT DOCUMENTS 7,552,996 B2 * 6/2009 Ochiai ..... B41J 2/155 347/13

FOREIGN PATENT DOCUMENTS

JP 2005059402 A 3/2005
JP 2007253483 A 10/2007
(Continued)

OTHER PUBLICATIONS

International Preliminary Report on Patentability and Written Opinion of the International Searching Authority corresponding to Application No. PCT/JP2014/082522; Date of Mailing: Jun. 28, 2016.
(Continued)

*Primary Examiner* — Thinh H Nguyen
(74) *Attorney, Agent, or Firm* — Cantor Colburn LLP

(57) ABSTRACT

Provided is an image-forming apparatus that limits reductions in image quality such as streaking even when print element discharge failure occurs in the overlap region of short heads that configure a long head. In the overlap region, among multiple overlap areas configured from rows of consecutive print elements that do not comprise print elements that have been specified as discharge failure print elements, the overlap area with the largest number of overlapping print elements is specified. When the number of print elements in said overlap area is greater than a fixed number, an overlap control for gradually changing the discharge apportionment for the fixed number of print elements in each short head is performed. Since the discharge failure of the print element is present in an area in which the short head print apportionment is 100%, the discharge failure is supplemented by, for example, increasing the discharge amounts of the adjacent print elements. But
(Continued)

because the discharge failure of the print element is present in an area in which the short head print apportionment is 0%, supplementation is not performed.

6 Claims, 13 Drawing Sheets

(56) References Cited

FOREIGN PATENT DOCUMENTS

| | | | |
|---|---|---|---|
| JP | 2011255594 | A | 12/2011 |
| JP | 2012006267 | A | 1/2012 |
| JP | 2012131110 | A | 7/2012 |
| WO | 2009150945 | A1 | 12/2009 |

OTHER PUBLICATIONS

International Search Report corresponding to Application No. PCT/JP2014/082522; Date of Mailing: Mar. 3, 2015, with English translation.

* cited by examiner

IMAGE-FORMING APPARATUS

This is the U.S. national stage of application No. PCT/JP2014/082522, filed on Dec. 9, 2014. Priority under 35 U.S.C. §119(a) and 35 U.S.C. §365(b) is claimed from Japanese Application No. 2013-270645, filed Dec. 27, 2013, the disclosure of which is also incorporated herein by reference.

TECHNICAL FIELD

The present invention relates to an image forming apparatus.

BACKGROUND ART

A conventional image forming apparatus, such as an ink-jet recording apparatus, ejects ink (recording material) from a plurality of nozzles (recording elements) to form an image on a recording sheet (a recording medium).

Some of the conventional image forming apparatuses include a long line head covering the length of a recording sheet in the main scanning direction. In such an image forming apparatus, the position of the line head is fixed during recording in the main scanning direction and a recording sheet is transferred in the direction (the sub scanning direction) orthogonal to the main scanning direction to form an image at high speed.

Unfortunately, the long line heads covering the width of a recording sheet have disadvantages of high manufacturing costs, low production yields and low reliability, compared to short heads. Moreover, a long line head with some broken recording elements requires the entire replacement of the expensive line head, resulting in high repair costs.

To solve the above problems, there is known an image forming apparatus including a long head formed by disposing a plurality of short heads in a main scanning direction in a state in which recording elements have an overlap region in the adjacent ends of the short heads, each of the short heads having a plurality of recording elements disposed in the main scanning direction, for example.

This structure may cause deviation of landing point of recording material and impair the image quality in the overlap region due to the misalignment between the short heads. To solve this problem, some of the conventional image forming apparatuses gradually change the ejection rates (ejection share rates) of ejecting recording material from recording elements of the short heads in the overlap region to reduce the extent of deviation of landing point of recording material (Patent Documents 1 and 2, for example).

However, an ejection defective recording element which cannot eject recording material or causes significant curved ejection of recording material in the overlap region may impair the image quality in the area corresponding to the ejection defective recording element.

To solve this problem, some of the conventional image forming apparatuses gradually change the ejection share rates of ejecting recording material from recording elements of the short heads while avoiding ejection defective recording element (Patent Document 3, for example).

PRIOR ART DOCUMENTS

Patent Documents

Patent Document 1: Japanese Patent Application Laid Open Publication No. 2012-131110

Patent Document 2: Japanese Patent Application Laid Open Publication No. 2007-253483

Patent Document 3: Japanese Patent Application Laid Open Publication No. 2011-255594

DISCLOSURE OF THE INVENTION

Problems to be Solved by the Invention

In the image forming apparatus disclosed in Patent Document 3, however, the region having the gradually changing ejection share rates of ejecting recording material may be small depending on the position of the ejection defective recording element. As a result, the ejection share rates steeply change and image quality is lowered only for this region, thus making streaky irregularities noticeable.

An object of the present invention is to provide an image forming apparatus which can make streaky irregularities unnoticeable in the overlap region of the short heads.

Means for Solving the Problem

In order to solve the above problems, according to the invention described in claim 1, there is provided an image forming apparatus that includes a line head formed as a long head by disposing a first short head and a second short head in one direction in a state in which recording elements have an overlap region in adjacent ends of the first short head and the second short head, each of the first short head and the second short head including a plurality of recording elements disposed in the one direction, wherein an array of dots is formed along a direction crossing an array direction of the recording elements by ejecting recording material from the first short head and the second short head, the image forming apparatus, including: an ejection controller which performs overlap control to form an array of dots in the overlap region by recording material ejected from the recording elements of the first short head and recording material ejected from the recording elements of the second short head and to eject the recording material from the first short head and the second short head while gradually changing ejection share rates in the overlap region of the recording material ejected from the recording elements of the first short head and the second short head from recording element sides adjacent to the overlap region to end sides of the first short head and the second short head in the overlap region; an ejection defective recording element identifier which identifies a recording element that is defective in ejection of recording material in the overlap region; and an overlap area identifier which identifies a plurality of overlap areas in the overlap region, each of the overlap areas including a line of consecutive recording elements not including the recording element identified by the ejection defective recording element identifier, and identifies an overlap area including a largest number of overlapping recording elements from among the identified plurality of overlap areas, wherein the ejection controller performs the overlap control within a range of the overlap area identified by the overlap area identifier.

According to the invention described in claim 2, in the image forming apparatus of claim 1, when the overlap area identified by the overlap area identifier includes a predetermined number of overlapping recording elements or more, the ejection controller performs the overlap control to the predetermined number of consecutive recording elements.

According to the invention described in claim 3, □ in the image forming apparatus according to claim 1 or 2, when a dot is to be formed at a position corresponding to the recording element which is defective in ejection, the ejection controller performs supplemental processing of ejecting recording material from a recording element adjacent to the recording element identified by the ejection defective recording element identifier.

According to the invention described in claim 4, □ in the image forming apparatus according to claim 3, in the supplemental processing, the ejection controller ejects recording material from a recording element which is not a target of the overlap control from among the recording element adjacent to the recording element identified by the ejection defective recording element identifier.

According to the invention described in claim 5, □ in the image forming apparatus according to claim 3 or 4, when a plurality of recording elements are identified as recording elements defective in ejection, the ejection controller performs the supplemental processing by only a recording element adjacent to a recording element disposed closer to a recording element side adjacent to the overlap region than a recording element which is a target of the overlap control from among the plurality of recording elements identified by the ejection defective recording element identifier.

According to the invention described in claim 6, □ in the image forming apparatus according to any one of claims 3 to 5, the ejection controller increases, by a predetermined amount, an amount of recording material to be ejected from the recording element which performs ejection of recording material by the supplemental processing.

Effects of the Invention

The present invention reduces the occurrence of streaky irregularities in the overlap region of the short heads.

EMBODIMENTS FOR CARRYING OUT THE INVENTION

Figure 1:
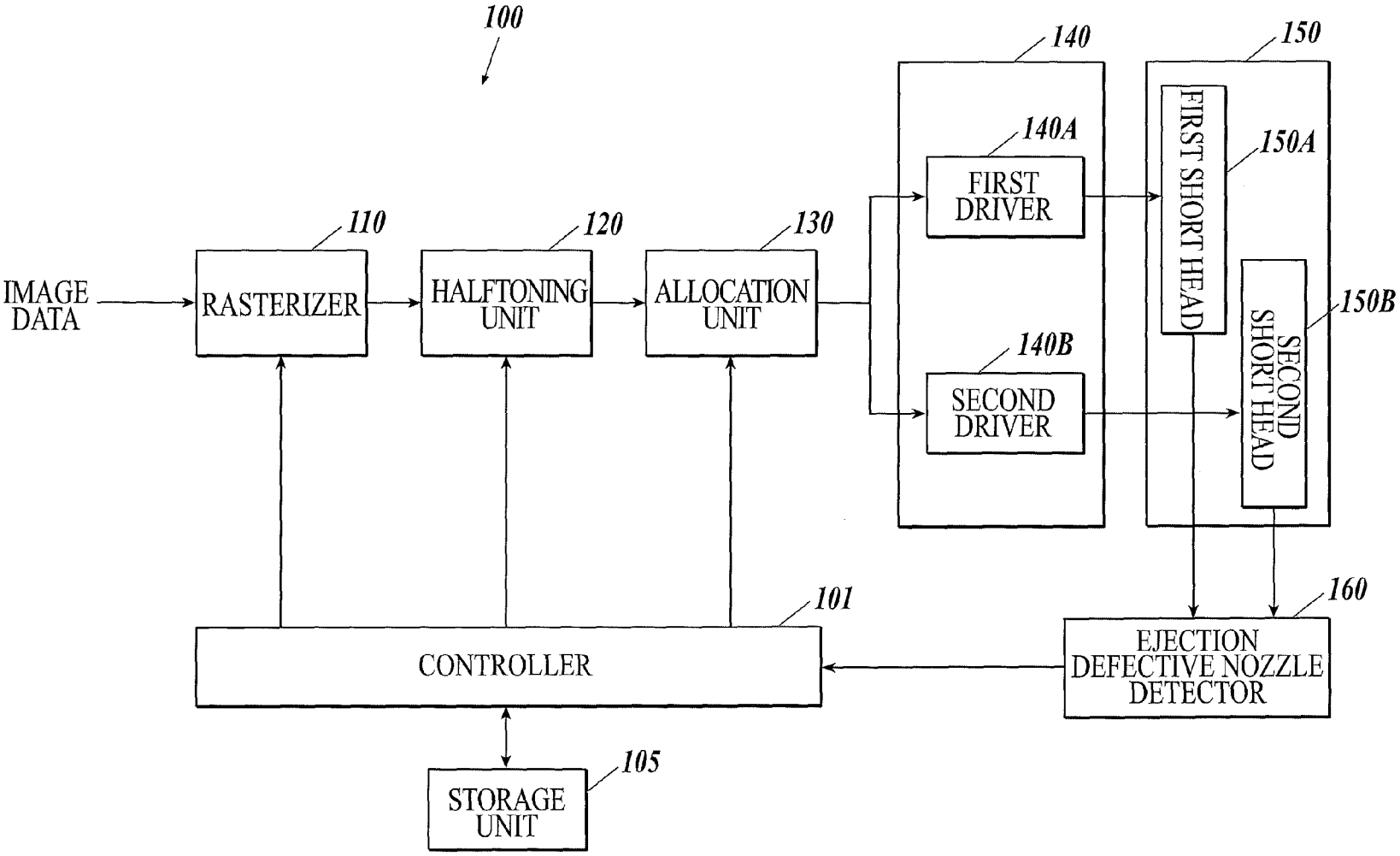
FIG. 1 This is a block diagram illustrating the functional configuration of the ink-jet recording apparatus according to an embodiment.

The ink-jet recording apparatus according to an embodiment of the present invention will now be described with reference to the accompanying drawings. It should be noted that the scope of the invention be not limited to the illustrated examples. In the following description, the same reference numerals are used for the elements having the identical functions or configurations for avoiding redundancy in description.

As shown in FIG. 1, an ink-jet recording apparatus 100 as an image forming apparatus includes a controller 101, a storage unit 105, a rasterizer 110, a halftoning unit 120, an allocation unit 130, a driving unit 140, a line head 150, and an ejection defective nozzle detector 160.

The controller 101 performs various processing for image formation. In this embodiment, the controller 101 functions as an ejection controller, an ejection defective recording element identifier and an overlap area identifier, the ejection controller performing overlap control to form an array of dots in the overlap region by recording material ejected from the recording elements of the first short head and recording material ejected from the recording elements of the second short head and to eject the recording material from the first short head and the second short head while gradually changing ejection share rates in the overlap region of the recording material ejected from the recording elements of the first short head and the second short head from recording element sides adjacent to the overlap region to end sides of the first short head and the second short head in the overlap region, and performing the overlap control within a range of the overlap area identified by the overlap area identifier and including the largest number of overlapping recording elements; the ejection defective recording element identifier identifying a recording element which is defective in ejection of recording material in the overlap region; and the overlap area identifier identifying a plurality of overlap areas in the overlap region, each of the overlap areas including a line of consecutive recording elements not including the identified ejection defective recording element, and identifying an overlap area including the largest number of overlapping recording elements from among the identified plurality of overlap areas.

The storage unit 105 is a storage unit which stores various data such as an output head allocation table (described below) and a threshold matrix.

The rasterizer 110 is an image processing unit which converts image data in various formats such as vector data fed from the outside such as a computer into rasterized data such as bitmapped data. If the resolution of the input data is different from that of the print image, the resolution is scaled up or down at this point to match the resolution of the rasterized data with that of the print image.

The halftoning unit 120 is a halftoning unit which generates halftoned data of dots for expressing multivalued data in area coverage modulation by dot number based on predetermined halftoning procedures. The halftoning unit 120 thresholds the rasterized data using matrix values stored in the storage unit 105, such as blue-noise matrix values or green-noise matrix values, in the predetermined halftoning procedures to generate the halftoned data corresponding to the dots to be recorded. In other words, the halftoning unit 120 compares the values in the input multivalued image data with the respective threshold values read out from the position corresponding to the input image data in the preinstalled threshold matrix in the predetermined halftoning procedures to perform halftoning, and causes the nozzles to eject ink to generate the halftoned data corresponding to the dots to be recorded.

The allocation unit 130 is an allocation unit which allocates halftoned data to one of the adjoining short heads for recording in the overlap region of the short heads with reference to the ejection share rates in the output head allocation table (described below) stored in the storage unit 105.

The driving unit 140 is a driving unit (driver) which drives the recording elements (nozzles) of the short heads (described below) to eject ink as recording material. In this embodiment, the driving unit 140 includes a first driver 140A and a second driver 140B.

The line head 150 is a line head formed as a long head by disposing a plurality of short heads in one direction in a state in which recording elements have an overlap region in adjacent ends of the short heads, each of the short heads including a plurality of recording elements disposed in the one direction. In this embodiment, the line head 150 includes a first short head 150A and a second short head 150B. The first short head 150A is driven by the first driver 140A and the second short head 150B is driven by the second driver 140B.

Figure 2:
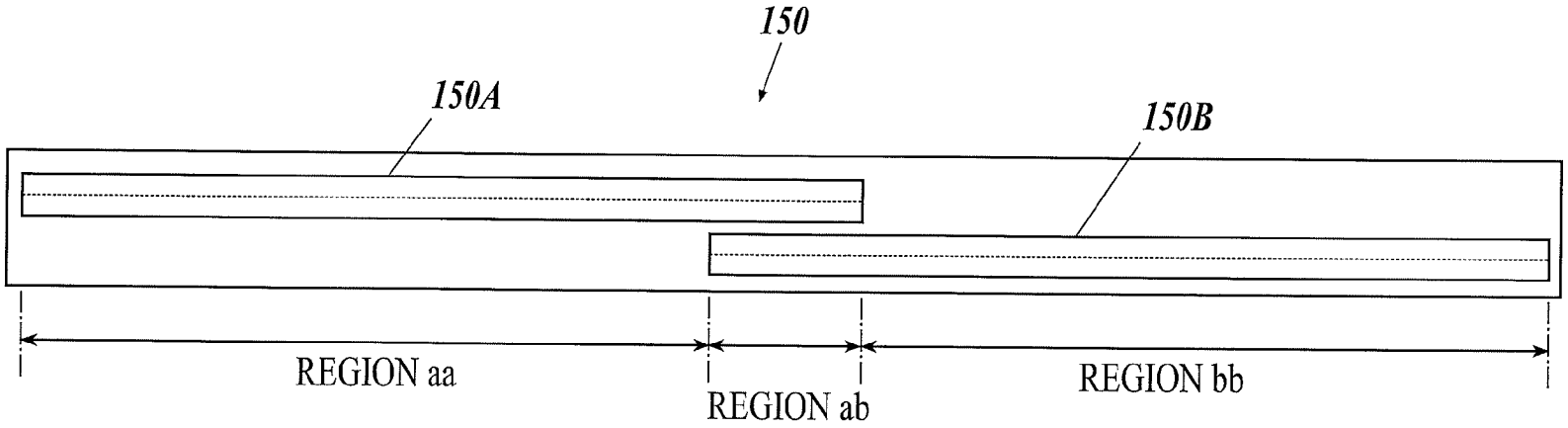
FIG. 2 This is a diagram illustrating the positional relationship between the recording elements of the ink-jet recording apparatus.

In this embodiment, the line head 150 includes two short heads, as shown in FIG. 1. FIG. 2 illustrates the positional relationship between the two heads. In the region aa, only the first short head 150A forms dots in image formation. Similarly, in the region bb, only the second short head 150B forms dots in image formation. In the overlap region ab, both of the first short head 150A and the second short head 150B form dots. FIG. 2 illustrates the view of the ink-ejecting side of the line head 150. The number of the recording elements of each of the short heads is merely an example and further recording elements are disposed depending on the recording density of an image in practice. Moreover, a larger number of short heads are disposed in a staggered arrangement, for example, into the line head 150 in practice. In this embodiment, each of the short heads may be composed of a combination of a plurality of heads having low recording density.

Figure 3:
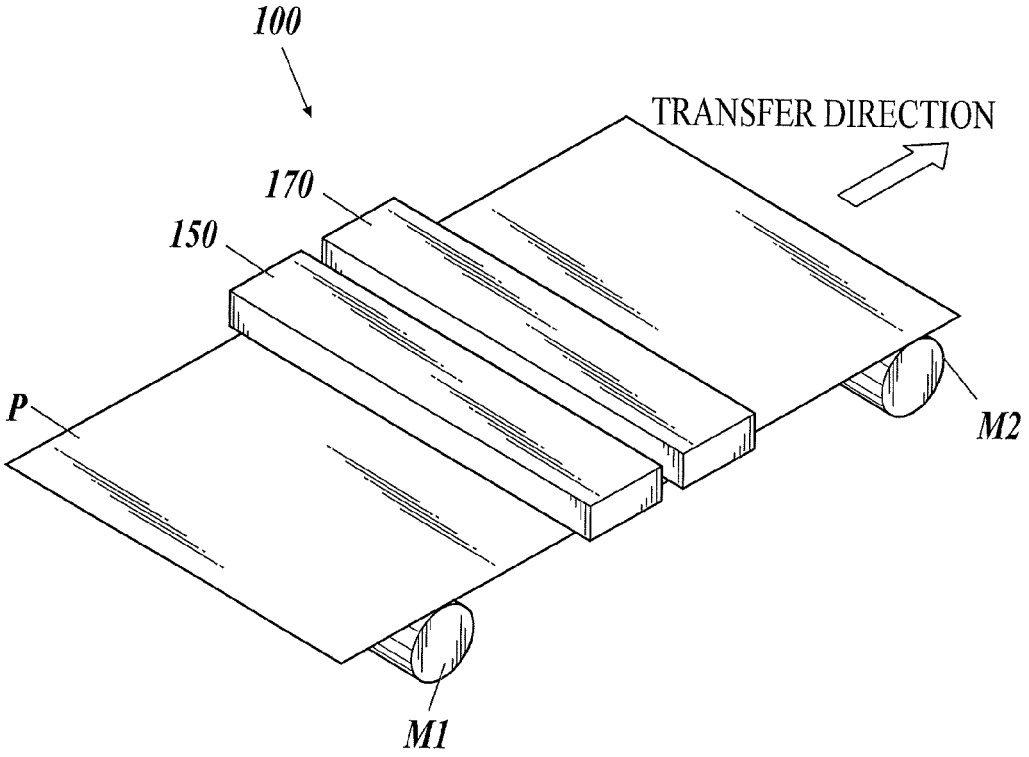
FIG. 3 This is a perspective view illustrating the outline configuration of the ink-jet recording apparatus.

The ink-jet recording apparatus 100 ejects ink from the recording elements of the line head 150 to a recording sheet P while transferring the recording sheet P with driving rollers M1 and M2 in the direction (the sub scanning direction) orthogonal to the longitudinal direction (the main scanning direction) of the line head 150, as shown in FIG. 3. Alternatively, the line head 150 may be moved such that the line head 150 and the recording sheet P are moved relative to each other in the transferring direction (the sub scanning direction), for example.

The image formed in ink is then fixed to the recording sheet P by heat or ultraviolet ray emitted from a fixing unit 170, if necessary.

The ejection defective nozzle detector 160 is a sensor which detects an ejection defective recording element which cannot properly eject ink from among the recording elements in each of the short heads. In this embodiment, the ejection defective nozzle detector 160 includes, for example, a line scanner and detects an ejection defective recording element by reading an image on a recording sheet P with the line scanner. However, the ejection defective nozzle detector 160 is not limited to this type.

For example, the ejection defective nozzle detector 160 may include a sensor having a light emitter and a light receptor at the positions enabling detection of ejection of ink from any nozzle (for example, at the ends in the array direction of the recording elements) and detect the ink ejected from each of the recording elements of the short heads in predetermined timing through detection of light reflection or interruption due to the ejection of ink with the optical sensor.

Figure 4:
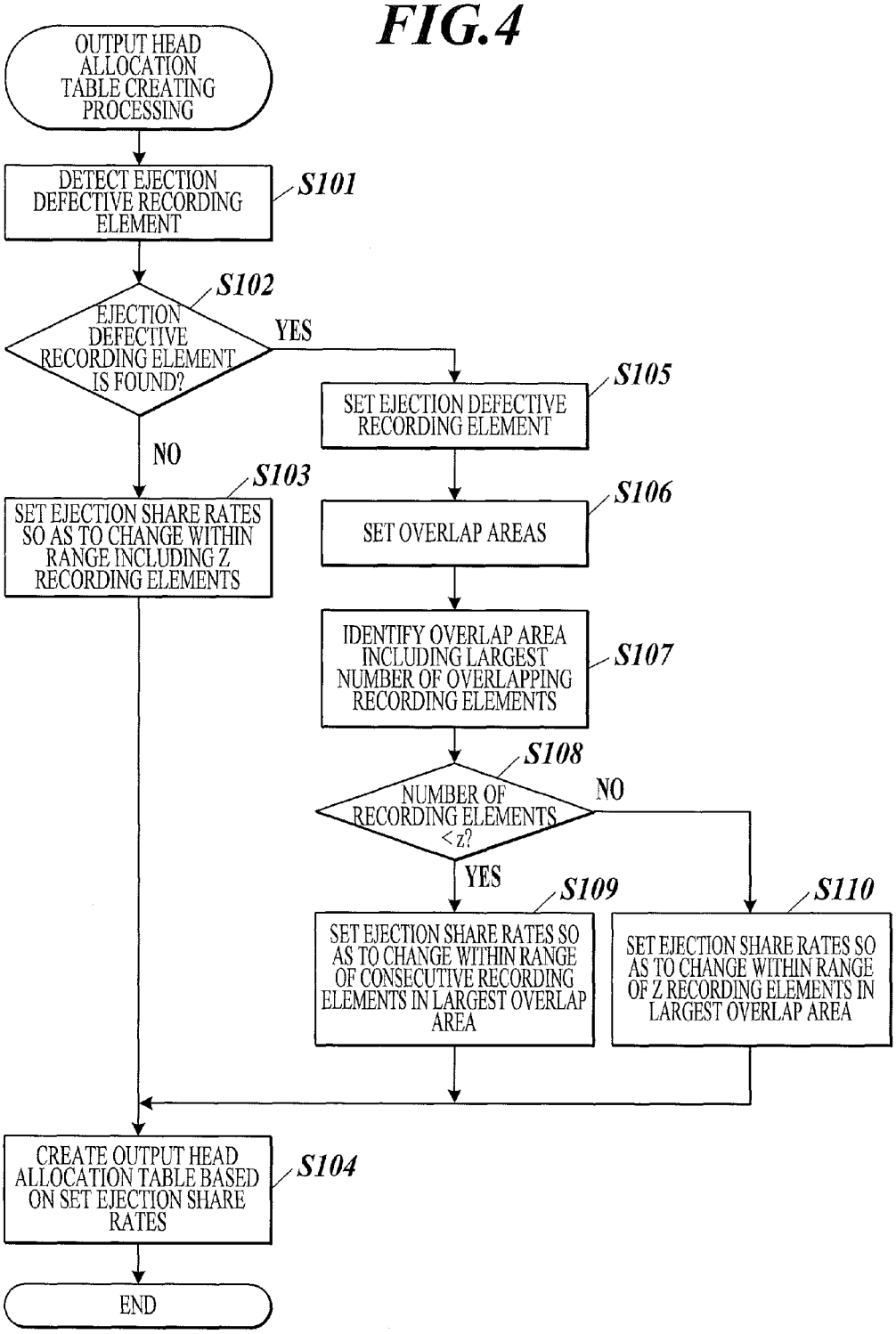
FIG. 4 This is a flow chart explaining output head allocation table creating processing.

The output head allocation table creating processing to be performed by the controller 101 will now be described with reference to FIG. 4. The processing is performed during the initial processing performed upon the start-up of the ink-jet recording apparatus 100, for example. The output head allocation table is used for allocation of halftoned data to one of the adjoining short heads for recording in the overlap region of the short heads.

The controller 101 identifies an ejection defective recording element in the overlap region (region ab) of the first short head 150A and the second short head 150B based on the detecting signals fed from the ejection defective nozzle detector 160 (Step S101).

The controller 101 determines whether an ejection defective recording element is found in the overlap region (Step S102).

If no ejection defective recording element is found (Step S102: N), the controller 101 sets the ejection share rates of the recording elements of the first short head 150A and the recording elements of the second short head 150B so as to gradually change the ejection share rates within the range of a predetermined number (fixed number z) of consecutive recording elements in the overlap region (Step S103).

Figure 5:
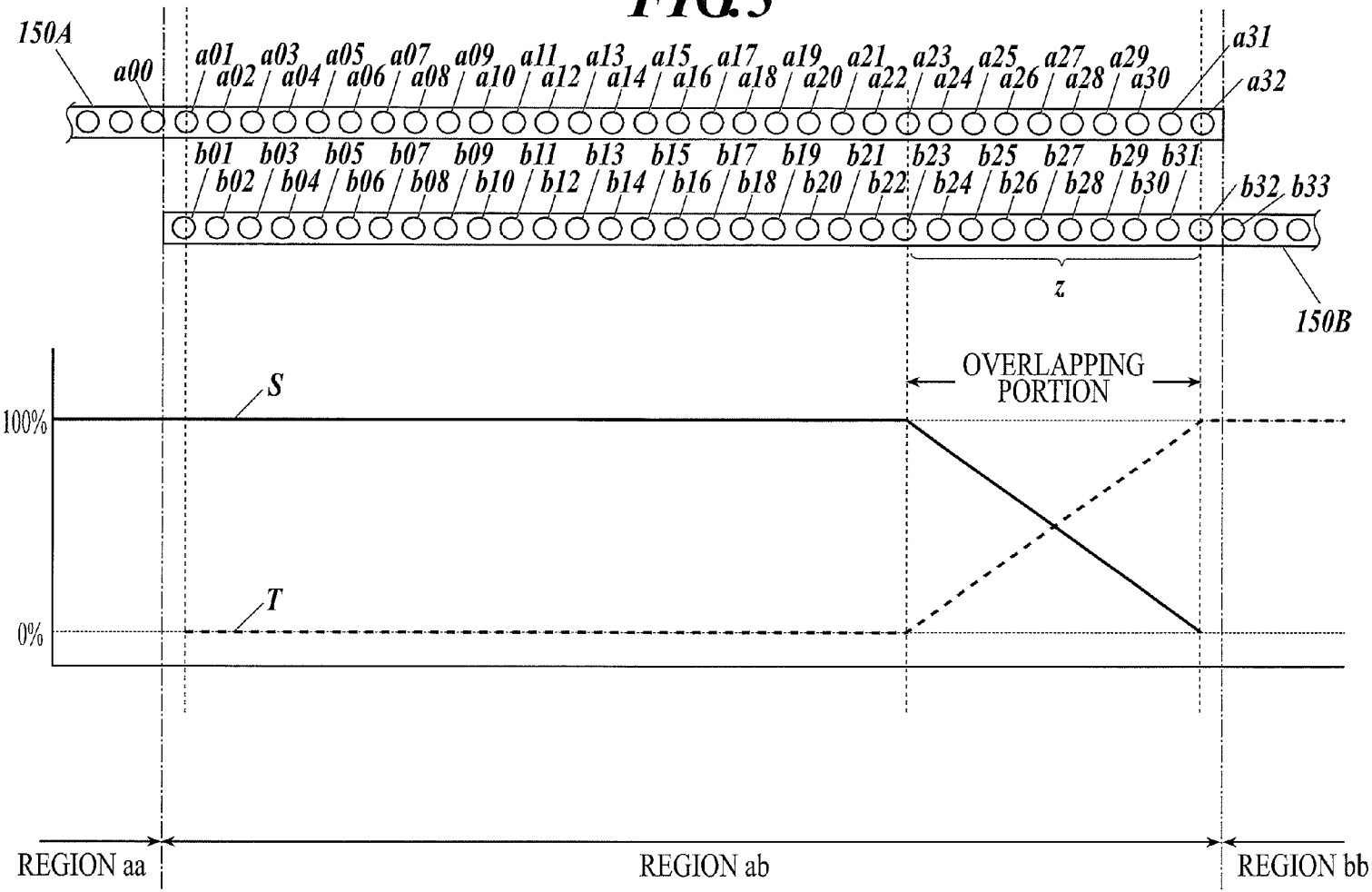
FIG. 5 This is a diagram illustrating the set ejection share rates of the short heads.

Specifically, as shown in FIG. 5, the first short head 150A includes thirty-two recording elements a01 to a32 in the overlap region (region ab). The recording element a00 is adjacent to the overlap region. The second short head 150B includes thirty-two recording elements b01 to b32 in the overlap region (region ab). The recording element b33 is adjacent to the overlap region. The recording elements a01 to a32 are disposed so as to overlap the recording elements b01 to b32, respectively, in the direction orthogonal to the array direction of the recording elements, that is, the sub scanning direction.

The example shown in FIG. 5 includes no ejection defective recording element in the overlap region. In this embodiment, for example, the portion consisting of z consecutive recording elements from the end side of the first short head 150A in the overlap region is identified as an overlapping portion. In this embodiment, the fixed number z is 10. Instead, the fixed number z may be any other figure. In the first short head 150A, the overlapping portion includes the recording elements a23 to a32. In the second short head 150B, the overlapping portion includes the recording elements b23 to b32. The overlapping portion is not limited to the above portion and may be any other portion. For example, evaluation may be performed to corresponding recording elements within the range of z consecutive recording elements to select recording elements having a smaller amount of positional deviation in the array direction of the recording elements and the overlapping portion may be formed of recording elements included in the selected range. The positional deviation in the array direction of recording element may be the maximum value of the deviation amounts in the array direction of recording elements in the range of the z recording elements or may be the total of the positional deviation amounts in the array direction of the recording elements in the range of the z recording elements.

After setting the overlapping portion, the controller 101 sets the ejection share rates of the recording elements of the first short head 150A and the recording elements of the second short head 150B in the overlap region. Specifically, as shown in FIG. 5, in the first short head 150A, the recording elements a01 to a22 have an ejection share rate of 100%, the recording element a22 being adjacent to the overlapping portion. In FIG. 5, the solid line S shows the ejection share rate for the first short head 150A. The recording elements a23 to a32 in the overlapping portion have the respective ejection share rates which gradually decrease from 100% to 0%. Although the ejection share rates change linearly in this embodiment, the rates may change non-linearly. Preferably, the ejection share rates change monotonically. For example, the ejection share rates may have a curved change convexly upward or downward, or may have a curved change in a discontinuous manner.

In the second short head 150B, the recording elements b01 to b22 have an ejection share rate of 0%, the recording element b22 being adjacent to the overlapping portion. In FIG. 5, the dashed line T shows the ejection share rate for the second short head 150B. The recording elements b23 to b32 in the overlapping portion have the respective ejection share rates which gradually increase from 0% to 100%.

As described above, the controller 101 can perform overlap control by changing the ejection share rates within the range of the recording elements a23 to a32 of the first short head 150A and the recording elements b23 to b32 of the second short head 150B.

After setting the ejection share rates of the recording elements a01 to a32 of the first short head 150A and the recording elements b01 to b32 of the second short head 150B, the controller 101 generates an output head allocation table for ejecting ink from the recording elements of the first short head 150A and the second short head 150B at the set ejection share rates (Step S104) and ends the processing.

If an ejection defective recording element is found in Step S102 (Step S102: Y), the controller 101 sets the ejection defective recording element (Step S105).

The controller 101 sets overlap areas including consecutive recording elements and not including the ejection defective recording element (Step S106).

The controller 101 then identifies the overlap area including the largest number of overlapping recording elements (overlapping recording elements number) (Step S107).

The controller 101 determines whether the number of the consecutive overlapping recording elements in the overlap area having the largest number of overlapping recording elements is smaller than the above-mentioned fixed number z (Step S108). If the number of the consecutive overlapping recording elements in the overlap area having the largest number of overlapping recording elements is smaller than the fixed number z (Step S108: Y), the controller 101 sets the ejection share rates of the recording elements of the first short head 150A and the recording elements of the second short head 150B so as to gradually change within the range of the number of the consecutive recording elements in the overlap area having the largest number of overlapping recording elements (Step S109) and performs the processing in Step S104.

If the number of the consecutive overlapping recording elements in the overlap area having the largest number of overlapping recording elements is not smaller than, i.e. is equal to or larger than the above-mentioned fixed number z (Step S108: N), the controller 101 sets the ejection share rates of the recording elements of the first short head 150A and the recording elements of the second short head 150B so as to gradually change within the range of a predetermined number of (fixed number Z) consecutive recording elements in the overlap area having the largest number of overlapping recording elements (Step S110) and performs the processing in Step S104.

Specifically, the above procedures for setting the ejection share rates are performed as follows.

Figure 6:
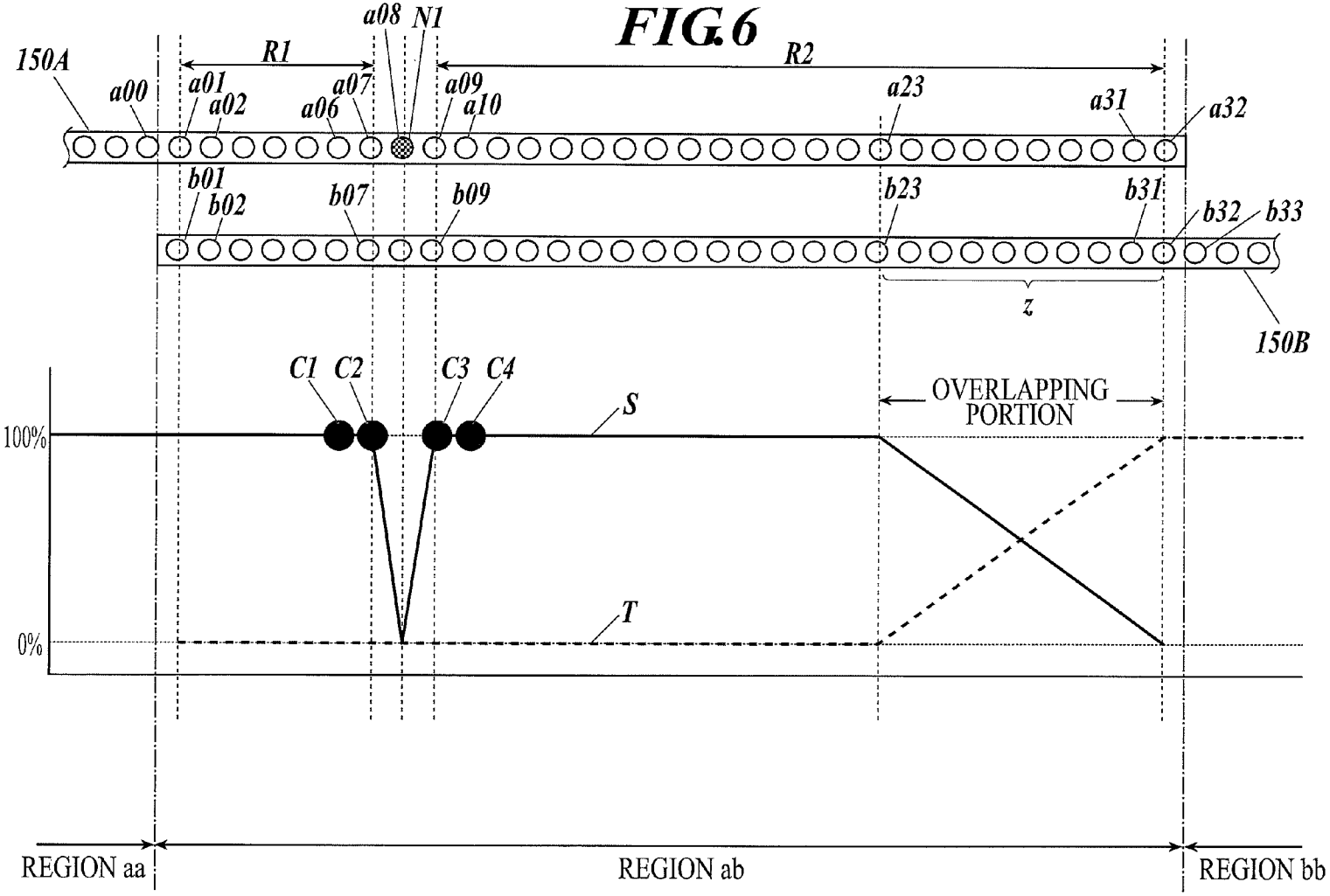
FIG. 6 This is a diagram illustrating the set ejection share rates of the short heads.

For example, as shown in FIG. 6, if the recording element a08 of the first short head 150A is found defective in ejection in the overlap region, the controller 101 sets the recording element a08 of the first short head 150A as the ejection defective recording element N1 in Step S105.

In Step S106, the controller 101 sets overlap areas based on the set ejection defective recording element N1. In the example shown in FIG. 6, the controller 101 sets two overlap areas, i.e. the overlap area R1 including the recording elements a01 to a07 of the first short head 150A and the recording elements b01 to b07 of the second short head 150B and the overlap area R2 including the recording elements a09 to a32 of the first short head 150A and the recording elements b09 to b32 of the second short head 150B, as the overlap areas each including a line of consecutive recording elements and not including the ejection defective recording element N1 in the overlap region.

In Step S107, the controller 101 identifies the overlap area having the largest number of overlapping recording elements from among the set overlap areas R1 and R2. In the example shown in FIG. 6, the overlap area R1 includes seven overlapping recording elements and the overlap area R2 includes twenty-four overlapping recording elements. The controller 101 thus identifies the overlap area R2 as the overlap area.

In the example shown in FIG. 6, since the number of overlapping recording elements in the overlap area R2 is equal to or larger than the fixed number z, the controller 101 sets the overlapping portion including z consecutive recording elements consecutive from the end side of the first short head 150A in the overlap area R2 in Step S110. Specifically, the controller 101 assigns the recording elements a23 to a32 of the first short head 150A and the recording elements b23 to b32 of the second short head 150B as recording elements forming the overlapping portion.

After setting the overlapping portion, the controller 101 sets the ejection share rates of the respective recording elements of the first short head 150A and the recording elements of the second short head 150B in the overlap region as described above. Since the recording element a08 of the first short head 150A is defective in ejection, the controller 101 sets the ejection share rate to 0% for the recording element a08 of the first short head 150A and the recording element b08 of the second short head 150B. In this embodiment, although the recording elements a08 and b08 do not eject ink, recording elements adjacent to the ejection defective recording element a08 of the first short head 150A perform supplemental processing to reduce the occurrence of streaky irregularities.

Figure 7:
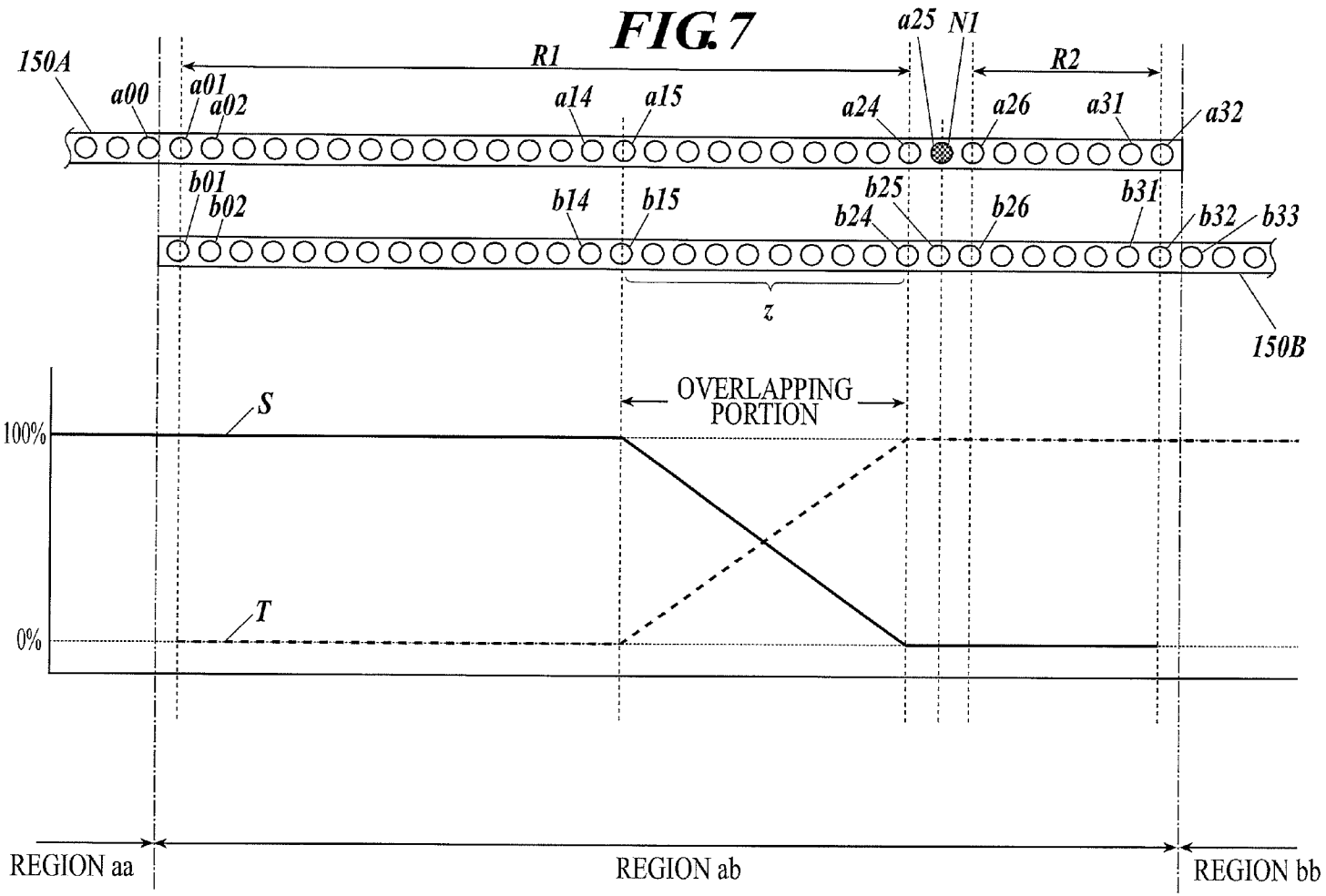
FIG. 7 This is a diagram illustrating the set ejection share rates of the short heads.

In the example shown in FIG. 7, the recording element a25 of the first short head 150A is found defective in the overlap region.

As shown in FIG. 7, if the recording element a25 of the first short head 150A is found defective in the overlap region, the controller 101 sets the recording element a25 of the first short head 150A as the ejection defective recording element N1 in Step S105.

In Step S106, the controller 101 sets overlap areas based on the set ejection defective recording element N1. In the example shown in FIG. 7, the controller 101 sets two overlap areas, i.e. the overlap area R1 including the recording elements a01 to a24 of the first short head 150A and the recording elements b01 to b24 of the second short head 150B, and the overlap area R2 including the recording elements a26 to a32 of the first short head 150A and the recording elements b26 to b32 of the second short head 150B, as the overlap areas including consecutive recording elements and not including the ejection defective recording element N1 in the overlap region.

In Step S107, the controller 101 identifies the overlap area having the largest number of overlapping recording elements from among the set overlap areas R1 and R2. In the example shown in FIG. 7, the overlap area R1 includes twenty-four overlapping recording elements and the overlap area R2 includes seven overlapping recording elements. The controller 101 thus sets the overlap area R1 as the overlap area.

In the example shown in FIG. 7, since the number of overlapping recording elements in the overlap area R1 is equal to or larger than the fixed number z, the controller 101 sets the overlapping portion including z consecutive recording elements which are consecutive from the end side of the first short head 150A in the overlap area R1 in Step S110. Specifically, the controller 101 assigns the recording elements a15 to a24 of the first short head 150A and the recording elements b15 to b24 of the second short head 150B as recording elements forming the overlapping portion.

After setting the overlapping portion, the controller 101 sets the ejection share rates of the recording elements of the first short head 150A and the recording elements of the second short head 150B in the overlap region as described above. Specifically, as shown in FIG. 7, for the first short head 150A, the controller 101 sets the ejection share rate to 100% for the recording elements a01 to a14, the recording element a14 being adjacent to the overlapping portion. The controller 101 sets the ejection share rates so as to gradually decrease from 100% to 0% for the recording elements a15 to a24 forming the overlapping portion. The controller 101 sets the ejection share rate to 0% for the recording elements a25 to a32, the recording element a25 being adjacent to the overlapping portion and the recording element a32 being at the end of the first short head 150A. Since the ejection defective recording element a25 of the short head 150A is already set to have an ejection share rate of 0%, the controller 101 does not change the ejection share rate for this element.

For the second short head 150B, the controller 101 sets the ejection share rate to 0% for the recording elements b01 to b14, the recording element b14 being adjacent to the overlapping portion. The controller 101 sets the ejection share rates so as to gradually increase from 0% to 100% for the recording elements b15 to b24 forming the overlapping portion. The controller 101 sets the ejection share rate to 100% for the recording elements b25 to b32, the recording element b25 being adjacent to the overlapping portion.

Figure 8:
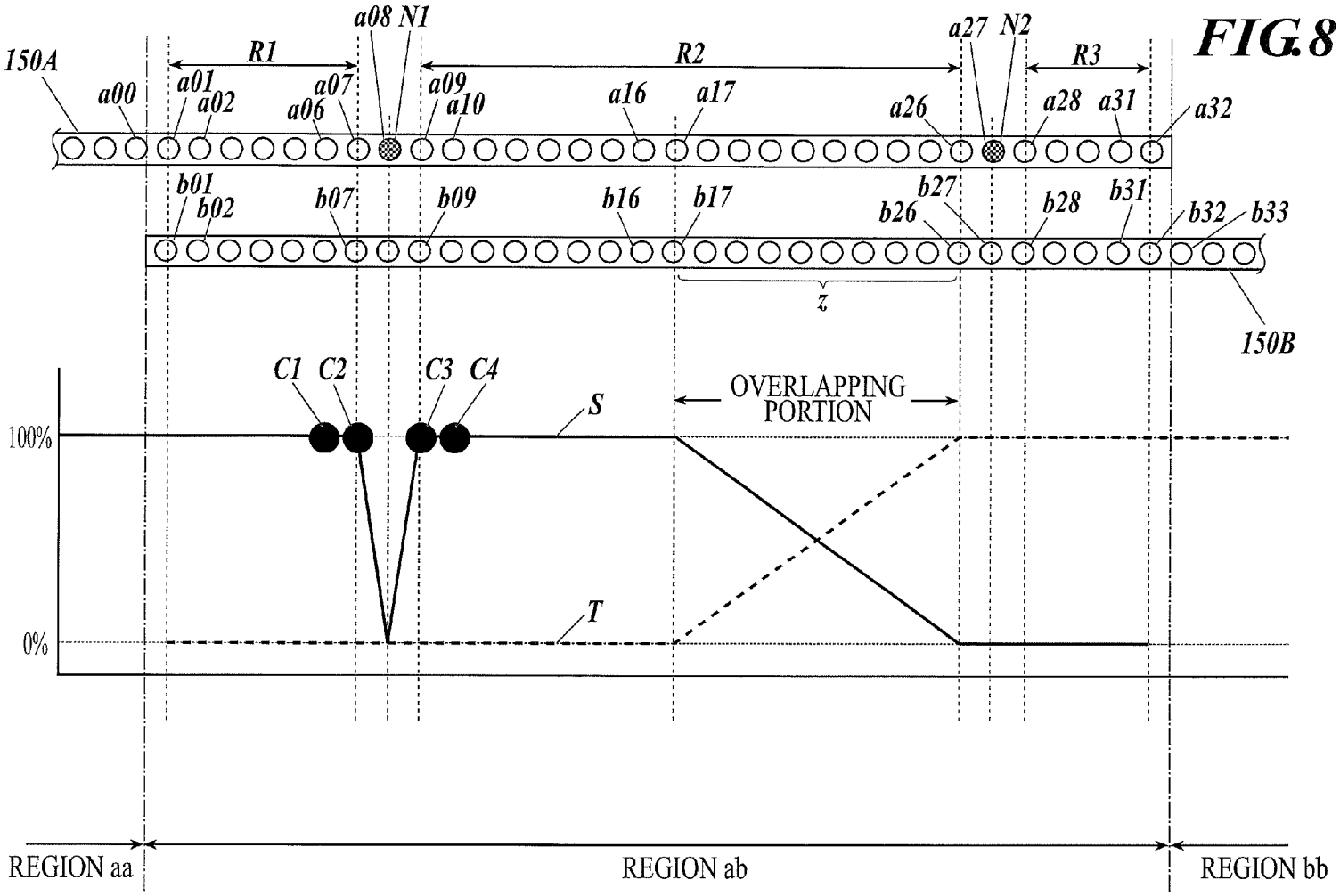
FIG. 8 This is a diagram illustrating the set ejection share rates of the short heads.

In the example shown in FIG. 8, the recording elements a08 and a27 of the first short head 150A are found defective in the overlap region.

As shown in FIG. 8, if the recording elements a08 and a27 of the first short head 150A are found defective in the overlap region, the controller 101 sets the recording element a08 of the first short head 150A as the ejection defective recording element N1 and the recording element a27 as the ejection defective recording element N2 in Step S105.

In Step S106, the controller 101 sets overlap areas based on the set ejection defective recording elements N1 and N2. In the example shown in FIG. 8, the controller 101 sets three overlap areas, i.e. the overlap area R1 including the recording elements a01 to a07 of the first short head 150A and the recording elements b01 to b07 of the second short head 150B, the overlap area R2 including the recording elements a09 to a26 of the first short head 150A and the recording elements b09 to b26 of the second short head 150B, and the overlap area R3 including the recording elements a28 to a32 of the first short head 150A and the recording elements b28 to b32 of the second short head 150B, as the overlap areas including consecutive recording elements and not including the ejection defective recording elements N1 and N2 in the overlap region.

In Step S107, the controller 101 identifies the overlap area having the largest number of overlapping recording elements from among the set overlap areas R1, R2, and R3. In the example shown in FIG. 8, the overlap area R1 includes seven overlapping recording elements, the overlap area R2 includes eighteen overlapping recording elements, and the overlap area R3 includes five overlapping recording elements. The controller 101 thus sets the overlap area R2 as the overlap area.

In the example shown in FIG. 8, since the number of overlapping recording elements in the overlap area R2 is equal to or larger than the fixed number z, the controller 101 sets, as the overlapping portion, the z consecutive recording elements which are consecutive from the end side of the first short head 150A in the overlap area R2 in Step S110. Specifically, the controller 101 assigns the recording elements a17 to a26 of the first short head 150A and the recording elements b17 to b26 of the second short head 150B as the recording elements forming the overlapping portion.

After setting the overlapping portion, the controller 101 sets the ejection share rates of the recording elements of the first short head 150A and the recording elements of the second short head 150B in the overlap region as described above. Specifically, as shown in FIG. 8, for the first short head 150A, the controller 101 sets the ejection share rate to 100% for the recording elements a01 to a16, the recording element a16 being adjacent to the overlapping portion. Since the recording element a08 of the first short head 150A is an ejection defective recording element, the controller 101 sets the ejection share rate to 0% for the recording element a08 of the first short head 150A. The controller 101 sets the ejection share rates so as to gradually decrease from 100% to 0% for the recording elements a17 to a26 forming the overlapping portion. The controller 101 sets the ejection share rate to 0% for the recording elements a27 to a32, the recording element a27 being adjacent to the overlapping portion and the recording element a32 being at the end of the first short head 150A. Since the ejection defective recording element a27 of the short head 150A is already set to have an ejection share rate of 0%, the controller 101 does not change the ejection share rate for this element.

For the second short head 150B, the controller 101 sets the ejection share rate to 0% for the recording elements b01 to b16, the recording element b16 being adjacent to the overlapping portion. The controller 101 sets the ejection share rates so as to gradually increase from 0% to 100% for the recording elements b17 to b26 forming the overlapping portion. The controller 101 sets the ejection share rate to 100% for the recording elements b27 to b32, the recording element b27 being adjacent to the overlapping portion.

Figure 9:
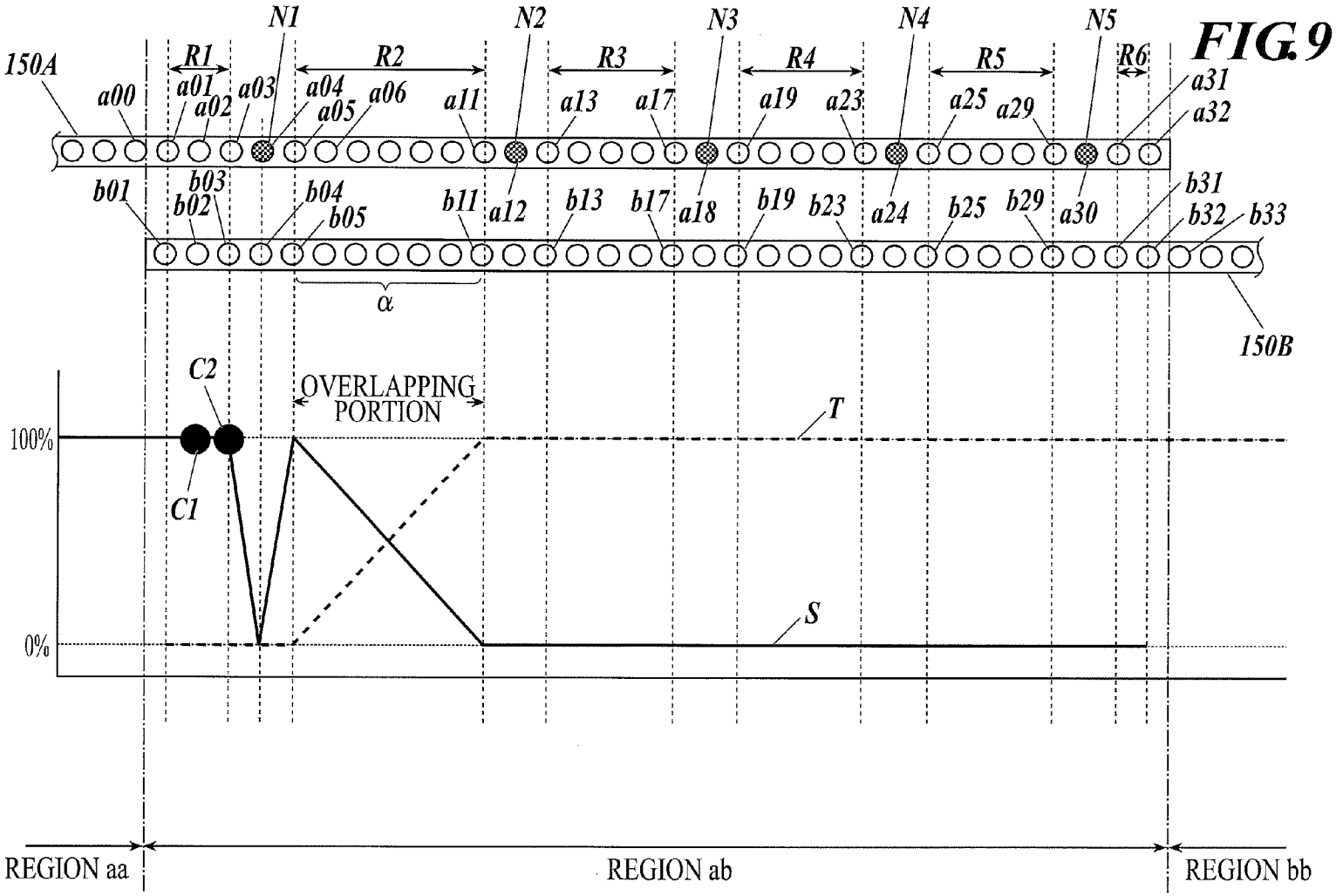
FIG. 9 This is a diagram illustrating the set ejection share rates of the short heads.

In the example shown in FIG. 9, the recording elements a04, a12, a18, a24, and a30 of the first short head 150A are found defective in the overlap region.

As shown in FIG. 9, if the recording elements a04, a12, a18, a24, and a30 of the first short head 150A are found defective in the overlap region, the controller 101 sets the recording element a04 of the first short head 150A as the ejection defective recording element N1, the recording element a12 as the ejection defective recording element N2, the recording element a18 as the ejection defective recording element N3, the recording element a24 as the ejection defective recording element N4, and the recording element a30 as the ejection defective recording element N5 in Step S105.

In Step S106, the controller 101 sets overlap areas based on the set ejection defective recording elements N1 to N5. In the example shown in FIG. 9, the controller 101 sets six overlap areas, i.e. the overlap area R1 including the recording elements a01 to a03 of the first short head 150A and the recording elements b01 to b03 of the second short head 150B, the overlap area R2 including the recording elements a05 to a11 of the first short head 150A and the recording elements b05 to b11 of the second short head 150B, the overlap area R3 including the recording elements a13 to a17 of the first short head 150A and the recording elements b13 to b17 of the second short head 150B, the overlap area R4 including the recording elements a19 to a23 of the first short head 150A and the recording elements b19 to b23 of the second short head 150B, the overlap area R5 including the recording elements a25 to a29 of the first short head 150A and the recording elements b25 to b29 of the second short head 150B, and the overlap area R6 including the recording elements a31 and a32 of the first short head 150A and the recording elements b31 and b32 of the second short head 150B, as the overlap areas including consecutive recording elements and not including the ejection defective recording elements N1 to N5 in the overlap region.

In Step S107, the controller 101 identifies the overlap area having the largest number of overlapping recording elements from among the set overlap areas R1 to R6. In the example shown in FIG. 9, the overlap area R1 includes three overlapping recording elements, the overlap area R2 includes seven overlapping recording elements, the overlap area R3 includes five overlapping recording elements, the overlap area R4 includes five overlapping recording elements, the overlap area R5 includes five overlapping recording elements, and the overlap area R6 includes two overlapping recording elements. The controller 101 thus sets the overlap area R2 as the overlap area.

In the example shown in FIG. 9, since the number of overlapping recording elements in the overlap area R2 is a which is smaller than the fixed number z (the number a is seven in the example shown in FIG. 9), the controller 101 assigns the a consecutive recording elements which are consecutive from the end side of the first short head 150A in the overlap area R2 as overlapping portion in Step S109. Specifically, the controller 101 assigns the recording elements a05 to a11 of the first short head 150A and the recording elements b05 to b11 of the second short head 150B as recording elements forming the overlapping portion.

After setting the overlapping portion, the controller 101 sets the ejection share rates of the recording elements of the first short head 150A and the recording elements of the second short head 150B in the overlap region as described above. Specifically, as shown in FIG. 9, for the first short head 150A, the controller 101 sets the ejection share rate to 100% for the recording elements a01 to a04, the recording element a04 being adjacent to the overlapping portion. Since the recording element a04 of the first short head 150A is defective, the controller 101 sets the ejection share rate to 0% for the recording element a04 of the first short head 150A. The controller 101 sets the ejection share rates so as to gradually decrease from 100% to 0% for the recording elements a05 to a11 forming the overlapping portion. The controller 101 sets the ejection share rate to 0% for the recording elements a12 to a32, the recording element a12 being adjacent to the overlapping portion and the recording element a32 being at the end of the first short head 150A. Since the ejection defective recording elements a12, a18, a24, and a30 of the short head 150A are already set to have an ejection share rate of 0%, the controller 101 does not change the ejection share rates for these elements. In the example shown in FIG. 9, as described below, recording elements adjacent to the ejection defective recording element a04 of the first short head 150A performs supplemental processing, however, since the recording elements a05 and a06 adjacent to the recording element a04 at the end side of the first short head 150A form the overlapping portion, the recording elements a05 and a06 do not perform the supplemental processing, and the supplemental processing is performed by only the recording elements a02 and a03 which are adjacent to the recording element a04 at the opposite side to the end side of the first short head 150A.

For the second short head 150B, the controller 101 sets the ejection share rate to 0% for the recording elements b01 to b04, the recording element b04 being adjacent to the overlapping portion. The controller 101 sets the ejection share rates so as to gradually increase from 0% to 100% for the recording elements b05 to b11 forming the overlapping portion. The controller 101 sets the ejection share rate to 100% for the recording elements b12 to b32, the recording element b12 being adjacent to the overlapping portion.

In the above description, the processing for setting the ejection share rates in the overlap region is performed in the case where the first short head 150A has ejection defective recording element(s), however, the processing for setting the ejection share rates in the overlap region is performed in the same way in the case where the second short head 150B has ejection defective recording element(s).

Figure 10:
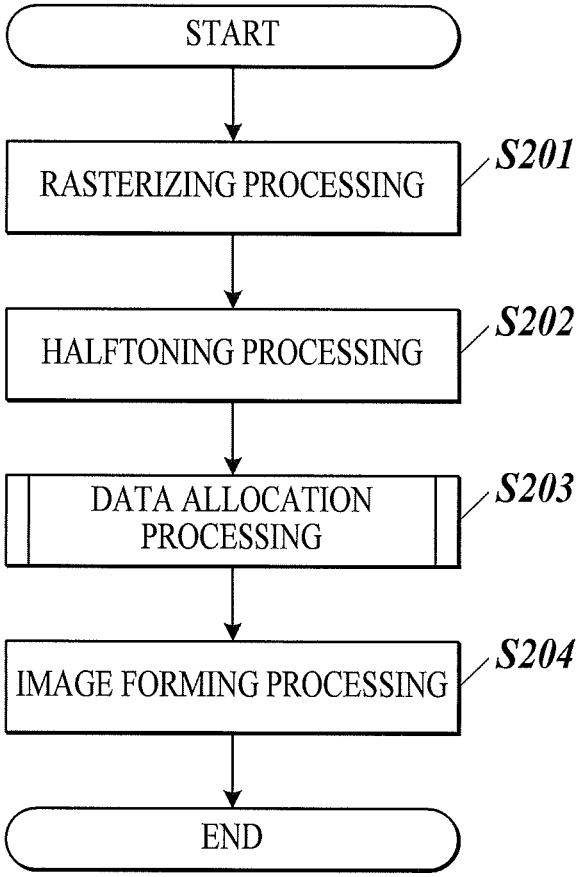
FIG. 10 This is a flow chart explaining the overall operation in image formation.

The operation of the ink-jet recording apparatus 100 (image forming method) will now be described with reference to FIG. 10.

The controller 101 controls the rasterizer 110 to convert image data in various formats such as vector data fed from the outside such as a computer into rasterized data, such as bitmapped data (Step S201). The storage unit 105 stores the vector data fed from the outside and the converted rasterized data in bitmapped form if necessary.

The controller 101 controls the halftoning unit 120 to perform halftoning processing for finally expressing the gradation by binary value in a pseudo manner of ejection or no ejection of ink when an image is formed by multivalued data having gradation (Step S202).

In detail, the halftoning unit 120 generates halftoned data of dots for expressing the multivalued data in area coverage modulation or such like based on predetermined halftoning procedures.

The halftoning unit 120 thresholds the rasterized data using threshold matrix values stored in the storage unit 105, such as blue-noise matrix values or green-noise matrix values, in the predetermined halftoning procedures, to generate the halftoned data including the dots to be recorded, the threshold matrix values being designed for reducing the low-frequency components in the halftone pattern which are generated during thresholding.

The controller 101 controls the allocation unit 130 to perform data allocation processing for determining which of the first short head 150A and the second short head 150B included in the line head 150 is used to perform recording for the overlap region (region ab in FIG. 2), and determine the short head to perform recording for each dot (step S203).

In detail, the allocation unit 130 allocates the data to one of the adjoining short heads for recording in the overlap region of the short heads with reference to the output head allocation table generated as described above. The data allocation processing will be described in detail below.

The controller 101 then ejects ink from the first short head 150A in the region aa in FIG. 2, from the second short head 150B in the region bb, and from one of the short heads allocated in the allocation processing in the region ab to form an image on a recording sheet P (Step S204).

Figure 11:
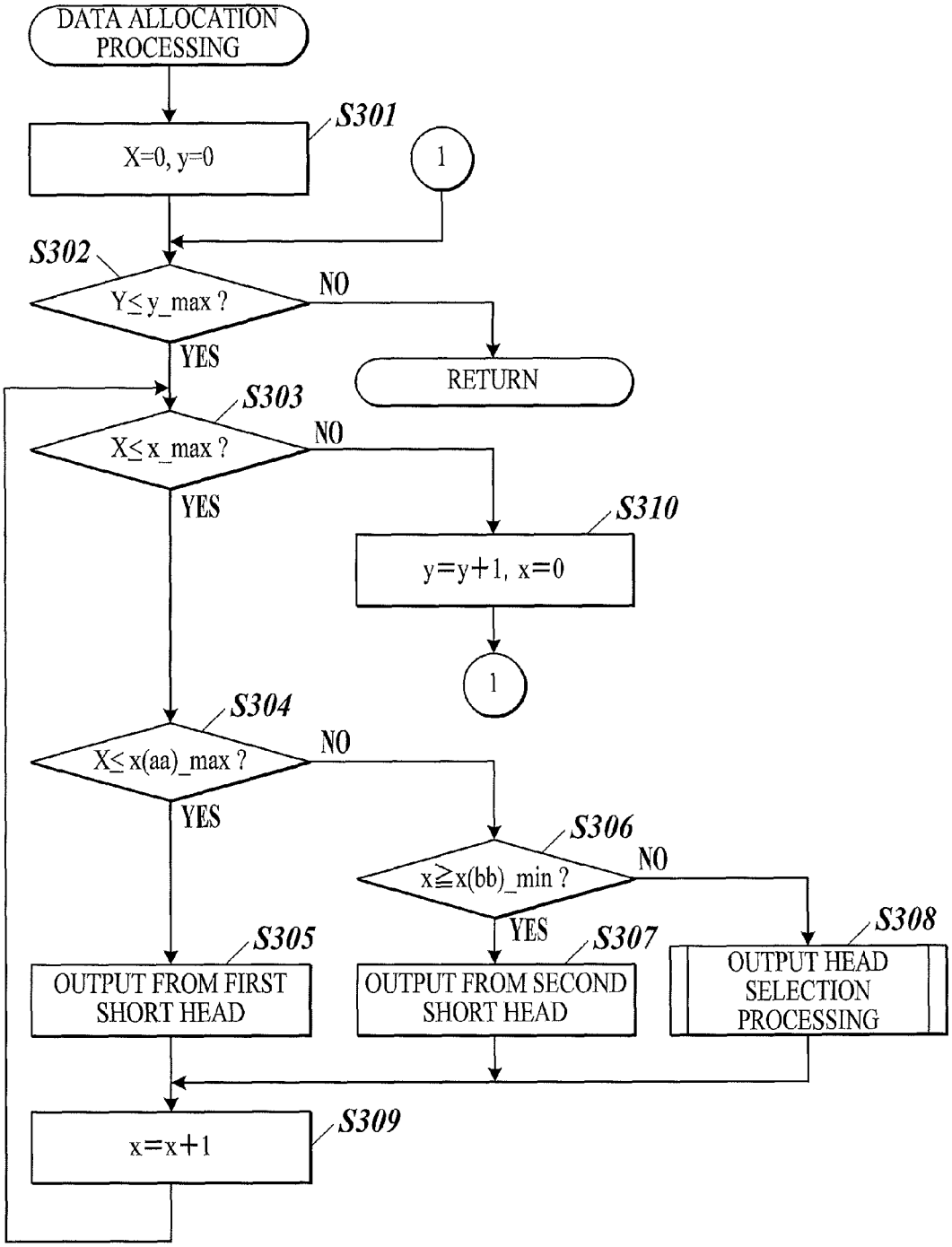
FIG. 11 This is a flow chart explaining data allocation processing.

The data allocation processing will now be described in detail with reference to FIG. 11.

The controller 101 sets the x and y coordinates of a pixel of interest in the halftoned dot data as x=0, y=0 which is the initial value (Step S301). The direction of the x axis corresponds to the array direction of the recording elements and the direction of the y axis corresponds to the transferring direction of a recording sheet P.

The controller 101 determines whether the y coordinate of the pixel of interest is equal to or smaller than the maximum coordinate value y_max in the image data in the direction of the y axis (Step S302). If the y coordinate of the pixel of interest is equal to or smaller than the maximum coordinate value y_max in the image data in the direction of the y axis (Step S302: Y), the controller 101 determines whether the x coordinate of the pixel of interest is equal to or smaller than the maximum coordinate value x_max in the image data in the direction of the x axis (Step S303).

If the x coordinate of the pixel of interest is equal to or smaller than the maximum coordinate value x_max in the image data in the direction of the x axis (Step S303: Y), the controller 101 determines whether the x coordinate of the pixel of interest is equal to or smaller than the maximum coordinate value x(aa)_max in the region aa including dots formed only by the first short head 150A in the direction of the x axis (i.e. the maximum coordinate value in the region not reaching the overlap region ab in the direction of the x axis) (Step S304).

If the x coordinate of the pixel of interest is equal to or smaller than the maximum coordinate value x(aa)_max in the region aa in the direction of the x axis (Step S304: Y), the pixel of interest is a dot in the region aa and thus the controller 101 sets a flag indicating that the dot should be output by the first short head 150A and stores the flag in the storage unit 105 so as to be associated with the dot (Step S305).

If the x coordinate of the pixel of interest is not equal to or smaller than the maximum coordinate value x(aa)_max in the region aa in the direction of the x axis, i.e. is larger than the maximum coordinate value x(aa)_max in the region aa in the direction of the x axis (Step S304: N), the controller 101 determines whether the x coordinate of the pixel of interest is equal to or larger than the minimum coordinate value x(bb)_min in the region bb including dots formed only by the second short head 150B in the direction of the x axis (i.e. the minimum coordinate value in the range not reaching the overlap region ab in the direction of x axis) (Step S306).

If the x coordinate of the pixel of interest is equal to or larger than the minimum coordinate value x(bb)_min in the region bb in the direction of the x axis (Step S306: Y), the pixel of interest is a dot in the region bb and thus the controller 101 sets a flag indicating that the dot should be output by the second short head 150B and stores the flag in the storage unit 105 so as to be associated with the dot (Step S307).

If the x coordinate of the pixel of interest is not equal to or larger than the minimum coordinate x(bb)_min in the region bb in the direction of the x axis, i.e. is smaller than the minimum coordinate value x(bb)_min in the region bb in the direction of the x axis (Step S306: N), the x coordinate of the pixel of interest is a dot in the overlap region ab and thus the controller 101 determines one of the first short head 150A and the second short head 150B to output the dot in output head selection processing, sets a flag indicating the results, and stores the flag in the storage unit 105 so as to be associated with the dot (Step S308). The output head selection processing will be described in detail below.

After determining one of the first short head 150A and the second short head 150B to output the dot in the pixel of interest, the controller 101 increments the x coordinate of the pixel of interest by one pixel in the direction of the x axis (Step S309) and performs the processing in Step S303.

If the x coordinate of the pixel of interest is not equal to or smaller than the maximum coordinate value x_max in the image data in the direction of the x axis, i.e. is larger than the maximum coordinate value x_max in the image data in the direction of the x axis (Step S303: N), the controller 101 increments the y coordinate of the pixel of interest by one pixel in the direction of the y axis and sets the x coordinate at zero (Step S310) and performs the processing in Step S302.

If the y coordinate of the pixel of interest is not equal to or smaller than the maximum coordinate value y_max in the image data in the direction of the y axis, i.e. is larger than the maximum coordinate value y_max in the image data in the direction of the y axis (Step S302: N), the controller 101 ends the processing.

Figure 12:
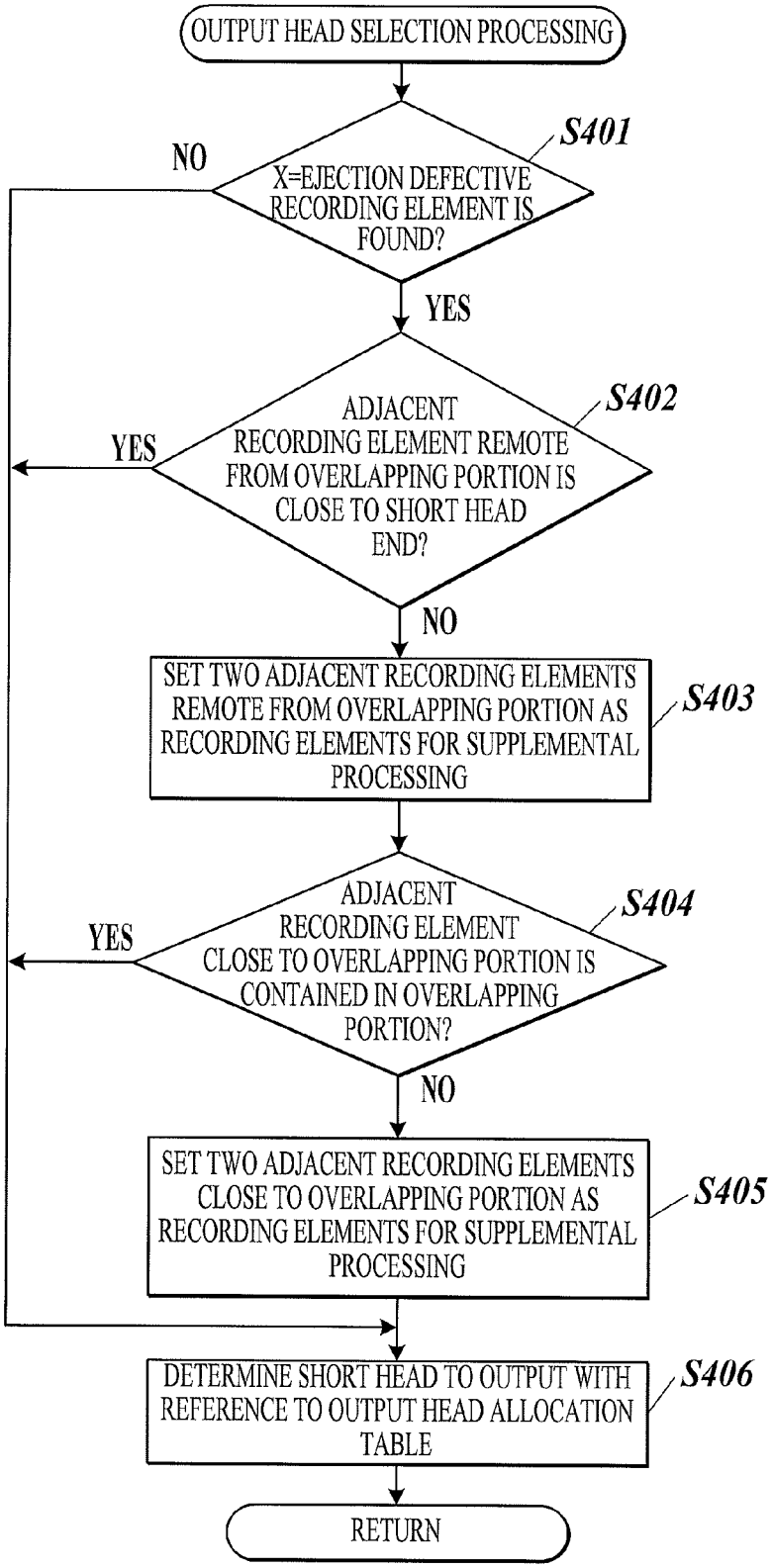
FIG. 12 This is a flow chart explaining output head selection processing.

The output head selection processing will now be described in detail with reference to FIG. 12.

The controller 101 determines whether at least one of the first short head 150A and the second short head 150B includes an ejection defective recording element having an x coordinate corresponding to that of the pixel of interest (Step S401).

If at least one of the first short head 150A and the second short head 150B includes an ejection defective recording element having an x coordinate corresponding to that of the pixel of interest (Step S401: Y), the controller 101 determines whether the recording element remote from the overlapping portion among the recording elements adjacent to the ejection defective recording element is in the end side of the short head (Step S402).

If the recording element adjacent to the ejection defective recording element and remote from the overlapping portion is not in the end side of the short head (Step S402: N), the controller 101 sets two recording elements adjacent to the ejection defective recording element and remote from the overlapping portion as the recording elements to perform the supplemental processing (Step S403).

The controller 101 then determines whether the recording element close to the overlapping portion among the recording elements adjacent to the ejection defective recording element is included in the overlapping portion (Step S404).

If the recording element adjacent to the ejection defective recording element and close to the overlapping portion is not included in the overlapping portion (Step S404: N), the controller 101 sets two recording elements adjacent to the ejection defective recording element and close to the overlapping portion as the recording elements to perform the supplemental processing (Step S405).

If neither of the first short head 150A and the second short head 150B includes an ejection defective recording element having an x coordinate corresponding to that of the pixel of interest (Step 401: N), the controller 101 does not perform the processing in Steps S402 to S405 and performs the processing in Step S406.

If the recording element adjacent to the ejection defective recording element and remote from the overlapping portion is in the end side of the short head (Step S402: Y), the controller 101 does not perform the processing in Steps S403 to S405 and performs the processing in Step S406.

If the recording element adjacent to the ejection defective recording element and close to the overlapping portion is included in the overlapping portion (Step S404: Y), the controller 101 does not perform the processing in Step S405 and performs the processing in Step S406.

According to the above procedures, for example, since the first short head 150A in the example shown in FIG. 6 includes the ejection defective recording element a08, the recording element remote from the overlapping portion among recording elements adjacent to the ejection defective recording element a08 is the recording element a07. Since the recording element a07 is not in the end side of the first short head 150A, the controller 101 sets two recording elements a06 and a07 adjacent to the ejection defective recording element a08 and remote from the overlapping portion as the recording elements C1 and C2, respectively, for the supplemental processing. Since the recording element a09 adjacent to the ejection defective recording element a08 and close to the overlapping portion is not included in the overlapping portion, the controller 101 sets two recording elements a09 and a10 adjacent to the ejection defective recording element a08 and close to the overlapping portion as the recording elements C3 and C4, respectively, for the supplemental processing.

Figure 13:
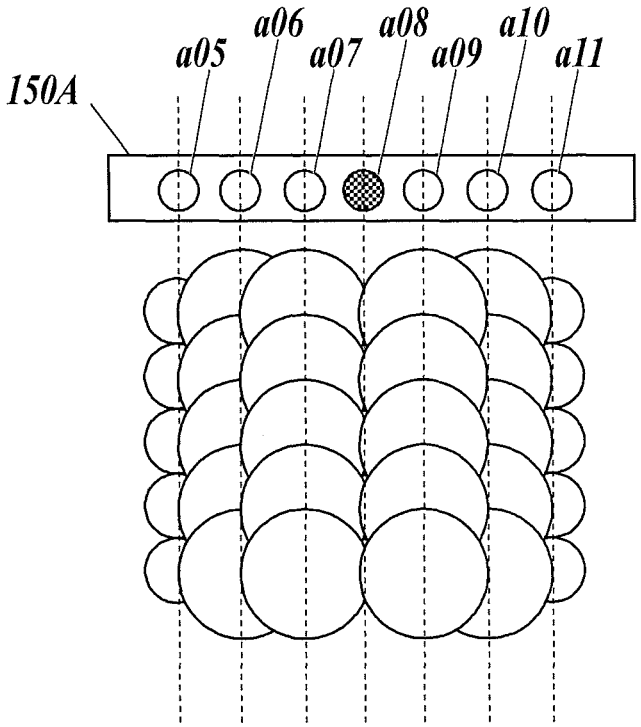
FIG. 13 This is a diagram illustrating supplemental processing.

In this embodiment, the ejection defective recording element which does not eject ink is supplemented by increasing a volume of ink to eject for one dot for increasing a dot diameter in the supplemental processing. In the example shown in FIG. 6, since neither of the ejection defective recording element a08 and the recording element b08 ejects ink, the recording elements a06, a07, a09, and a10 adjacent to the recording element a08 eject larger volumes of ink than the other recording elements for increasing a dot diameter, as shown in FIG. 13, which reduces streaky irregularities caused by absence of ejection of ink from the recording element a08.

In this embodiment, the recording elements a06, a07, a09, and a10 form dots having the same diameter, however, the recording elements a06 and a10 for the supplemental processing remote from the recording element a08 may form dots having a smaller diameter than the diameter of dots formed by the recording elements a07 and a09 adjacent to the recording element a08.

Alternatively, only the recording elements a07 and a09 adjacent to the recording element a08 may perform the supplemental processing.

In this embodiment, the supplemental processing is performed by increasing the amount of ink to eject, however, the processing may be performed in any known way, for example, by increasing the number of dots. Alternatively, the supplemental processing may be performed by allocating the dot forming rate of the ejection defective recording element a08 to the recording elements a06, a07, a09, and a10 adjacent to the recording element a08, or by combination of the allocation and the increase of ink ejection volume when there is no sufficient allocation point, for example.

In the example shown in FIG. 7, since the first short head 150A includes the ejection defective recording element a25, the recording element remote from the overlapping portion among the recording elements adjacent to the recording element a25 is the recording element a26. Since the recording element a26 is in the end side of the first short head 150A, the controller 101 does not set any recording element adjacent to the ejection defective recording element a25 as the recording element for the supplemental processing.

In the example shown in FIG. 8, the first short head 150A includes the ejection defective recording elements a08 and a27. Among the recording elements adjacent to the recording element a08, the recording element a07 is remote from the overlapping portion. Since the recording element a07 is not in the end side of the first short head 150A, the controller 101 sets two recording elements a06 and a07 adjacent to the ejection defective recording element a08 and remote from the overlapping portion as the recording elements C1 and C2, respectively, for the supplemental processing. Since the recording element a09 adjacent to the ejection defective recording element a08 and close to the overlapping portion is not included in the overlapping portion, the controller 101 sets two recording elements a09 and a10 adjacent to the ejection defective recording element a08 and close to the overlapping portion as the recording elements C3 and C4, respectively, for the supplemental processing. Among the recording elements adjacent to the recording element a27, the recording element a28 is remote from the overlapping portion. Since the recording element a28 is in the end side of the first short head 150A, the controller 101 does not set any recording element adjacent to the ejection defective recording element a27 as the recording element for the supplemental processing. In this embodiment, in such way, if a plurality of ejection defective recording elements are found, among the plurality of recording elements, the supplemental processing is performed only by the recording elements a06, a07, a09, and a10 adjacent to the recording element a08 which is closer to the recording element a00 adjacent to the overlap region than the recording elements a17 to a26 in the overlapping portion.

In the example shown in FIG. 9, the first short head 150A includes the ejection defective recording elements a04, a12, a18, a24, and a30. Among the recording elements adjacent to the recording element a04, the recording element a03 is remote from the overlapping portion. Since the recording element a03 is not in the end side of the first short head 150A, the controller 101 sets two recording elements a02 and a03 adjacent to the ejection defective recording element a04 and remote from the overlapping portion as the recording elements C1 and C2, respectively, for the supplemental processing. Since the recording element a05 adjacent to the ejection defective recording element a04 and close to the overlapping portion is included in the overlapping portion, the controller 101 does not set the recording element a05 and the neighboring recording element a06 as the recording elements for the supplemental processing. Among the recording elements adjacent to the ejection defective recording element a12, the recording element a13 is remote from the overlapping portion. Since the recording element a13 is in the end side of the first short head 150A, the controller 101 does not set any recording element adjacent to the ejection defective recording element a12 as the recording element for the supplemental processing. The same is applied to the ejection defective recording elements a18, a24, and a30.

After setting the recording elements for the supplemental processing, in step S406, the controller 101 determines one of the first short head 150A and the second short head 150B to output a dot with reference to the output head allocation table generated as described above, sets a flag indicating the results, stores the flag in the storage unit 105 so as to be associated with the dot (Step S406), and ends the processing.

As described above, in this embodiment, the line head 150 is formed as a long head by disposing a first short head 150A and a second short head 150B in one direction in a state in which recording elements have an overlap region in adjacent ends of the first short head 150A and the second short head 150B, each of the first short head 150A and the second short head 150B including a plurality of recording elements disposed in the one direction. The control unit 101 performs overlap control to form an array of dots in the overlap region by recording material ejected from the recording elements of the first short head 150A and recording material ejected from the recording elements of the second short head 150B and to eject the recording material from the first short head 150A and the second short head 150B while gradually changing ejection share rates in the overlap region of the recording material ejected from the recording elements of the first short head 150A and the second short head 150B from recording element sides adjacent to the overlap region to end sides of the first short head 150A and the second short head 150B in the overlap region. The control unit 101 identifies a recording element which is defective in ejection of recording material in the overlap region. The control unit 101 identifies, in the overlap region, a plurality of overlap areas each of which includes a line of consecutive recording elements not including the recording element identified as the ejection defective recording element, and identifies an overlap area including a largest number of overlapping recording elements from among the identified plurality of overlap areas. The control unit 101 performs the overlap control within a range of the overlap area including the largest number of overlapping recording elements. Accordingly, the controller 101 performs overlap control in the longest overlap area as possible and thus reduces streaky irregularities caused by the steep change in the ejection share rates of recording material, which makes the streaky irregularities unnoticeable in the overlap region of the short heads.

In this embodiment, if the number of the overlapping recording elements forming the overlap area including the largest number of overlapping recording elements is equal to or larger than the fixed number z, the controller 101 performs overlap control by z consecutive recording elements. Accordingly, the controller 101 can perform overlap control within a fixed range, which can suppress variability in the image quality for each connection part of short heads.

In this embodiment, the controller 101 performs supplemental processing of ejecting recording material from recording elements adjacent to an ejection defective recording element when forming a dot at a position corresponding to the ejection defective recording element. Accordingly, where there is an ejection defective recording element, the controller 101 can make streaky irregularities unnoticeable, the streaky irregularities being caused in the region corresponding to the ejection defective recording element.

In this embodiment, in the supplemental processing, the controller 101 ejects recording material from recording elements which are not a target of the overlap control among the recording elements adjacent to an ejection defective recording element. Accordingly, the controller 101 reduces irregularity in the distribution of dots to be generated by the recording element that is the target of overlap control, which can suppress the decrease in image quality.

In this embodiment, if a plurality of ejection defective recording elements are found, the controller 101 performs the supplemental processing only with recording elements adjacent to the recording element which is disposed closer to the recording element side adjacent to the overlap region than the recording elements which are the target of overlap control among the plurality of ejection defective recording elements. Accordingly, the controller 101 minimizes the necessity of performing the supplemental processing and suppress the decrease in image quality.

In this embodiment, the controller 101 increases the amount of recording material, by a predetermined amount, to be ejected from the recording elements for the supplemental processing, which simplifies the supplemental processing.

The embodiment of the present invention described above is merely an example of the ink-jet recording apparatus according to the present invention and not limitative. Modifications can be appropriately made to detailed configuration and detailed operation of each functional unit of the ink-jet recording apparatus.

In this embodiment, in a case where the number of the recording elements forming the overlap area including the largest number of overlapping recording elements among a plurality of overlap areas is smaller than the fixed number z, the controller 101 also sets the overlapping portion for the overlap area to set the ejection share rates; however, the controller 101 may not set the ejection share rates in that case and may perform a predetermined error notification, for example.

In this embodiment, overlap control is performed to z recording elements among the recording elements forming the overlap area including the largest number of overlapping recording elements among a plurality of overlap areas; however, overlap control may be performed to all the recording elements forming the overlap area.

In this embodiment, supplemental processing is performed by recording elements adjacent to an ejection defective recording element, however, the supplemental processing may not be performed.

In this embodiment, the computer readable medium storing the program according to the present invention is a hard disk or a semiconductor non-volatile memory; however, the computer readable medium may not be limited to this type. The computer readable medium may be a portable recording medium such as a CD-ROM. Moreover, carrier waves may be used as the media for providing the program data according to the present invention via a communication line.

INDUSTRIAL APPLICABILITY

The present invention can be applied to an image forming apparatus.

EXPLANATION OF REFERENCE NUMERALS

100 ink-jet recording apparatus (image forming apparatus)
101 controller (ejection controller, ejection defective recording element identifier, overlap area identifier)
150 line head
150A first short head
150B second short head

The invention claimed is:

1. An image forming apparatus that includes a line head formed as a long head by disposing a first short head and a second short head in one direction in a state in which recording elements have an overlap region in adjacent ends of the first short head and the second short head, each of the first short head and the second short head including a plurality of recording elements disposed in the one direction, wherein an array of dots is formed along a direction crossing an array direction of the recording elements by ejecting recording material from the first short head and the second short head, the image forming apparatus, comprising:

an ejection controller which performs overlap control to form an array of dots in the overlap region by recording material ejected from the recording elements of the first short head and recording material ejected from the recording elements of the second short head and to eject the recording material from the first short head and the second short head while gradually changing ejection share rates in the overlap region of the recording material ejected from the recording elements of the first short head and the second short head from recording element sides adjacent to the overlap region to end sides of the first short head and the second short head in the overlap region;

an ejection defective recording element identifier which identifies a recording element that is defective in ejection of recording material in the overlap region; and an overlap area identifier which identifies a plurality of overlap areas in the overlap region, each of the overlap areas including a line of consecutive recording elements not including the recording element identified by the ejection defective recording element identifier, and identifies an overlap area including a largest number of overlapping recording elements from among the identified plurality of overlap areas, wherein the ejection controller performs the overlap control within a range of the overlap area identified by the overlap area identifier.

2. The image forming apparatus according to claim 1, wherein, when the overlap area identified by the overlap area identifier includes a predetermined number of overlapping recording elements or more, the ejection controller performs the overlap control to the predetermined number of consecutive recording elements.

3. The image forming apparatus according to claim 1, wherein, when a dot is to be formed at a position corresponding to the recording element which is defective in ejection, the ejection controller performs supplemental processing of ejecting recording material from a recording element adjacent to the recording element identified by the ejection defective recording element identifier.

4. The image forming apparatus according to claim 3, wherein, in the supplemental processing, the ejection controller ejects recording material from a recording element which is not a target of the overlap control from among the recording element adjacent to the recording element identified by the ejection defective recording element identifier.

5. The image forming apparatus according to claim 3, wherein, when a plurality of recording elements are identified as recording elements defective in ejection, the ejection controller performs the supplemental processing by only a recording element adjacent to a recording element disposed closer to a recording element side adjacent to the overlap region than a recording element which is a target of the overlap control from among the plurality of recording elements identified by the ejection defective recording element identifier.

6. The image forming apparatus according to claim 3, wherein the ejection controller increases, by a predetermined amount, an amount of recording material to be ejected from the recording element which performs ejection of recording material by the supplemental processing.

* * * * *